US007942679B1

(12) United States Patent
Gretz

(10) Patent No.: US 7,942,679 B1
(45) Date of Patent: May 17, 2011

(54) GROUNDING TERMINAL BLOCK ASSEMBLY INCLUDING CONDUIT ADAPTER FOR MULTIPLE SERVICES

(75) Inventor: Thomas J. Gretz, Port St. Lucie, FL (US)

(73) Assignee: Arlington Industries, Inc., Scranton, PA (US)

( * ) Notice: Subject to any disclaimer, the term of this patent is extended or adjusted under 35 U.S.C. 154(b) by 197 days.

(21) Appl. No.: 12/460,218

(22) Filed: Jul. 15, 2009

Related U.S. Application Data

(63) Continuation-in-part of application No. 12/288,968, filed on Oct. 24, 2008, now Pat. No. 7,591,656, which is a continuation-in-part of application No. 12/287,244, filed on Oct. 7, 2008, now Pat. No. 7,537,467.

(51) Int. Cl.
*H01R 4/66* (2006.01)
*H01R 11/09* (2006.01)
*H01R 4/36* (2006.01)

(52) U.S. Cl. ..... 439/108; 439/798; 439/810

(58) Field of Classification Search ..... 439/108, 439/95, 721, 540.1, 814, 797, 798, 810, 709; 361/119

See application file for complete search history.

(56) References Cited

U.S. PATENT DOCUMENTS

| | | | | |
|---|---|---|---|---|
| 4,456,326 | A * | 6/1984 | Sauber | 439/540.1 |
| 4,697,720 | A | 10/1987 | Hotchkiss et al. | |
| 4,820,206 | A * | 4/1989 | Jullien et al. | 439/782 |
| 5,893,538 | A * | 4/1999 | Onishi et al. | 248/65 |
| 5,931,708 | A * | 8/1999 | Annas et al. | 439/798 |
| 6,176,747 | B1 * | 1/2001 | Rowe et al. | 439/721 |
| 6,497,592 | B1 * | 12/2002 | Beadle | 439/814 |
| 6,551,135 | B2 | 4/2003 | Stekelenburg | |
| 7,011,551 | B2 * | 3/2006 | Johansen et al. | 439/709 |
| 7,121,901 | B1 * | 10/2006 | Chen | 439/718 |
| 7,537,467 | B1 * | 5/2009 | Gretz | 439/108 |
| 7,591,656 | B1 * | 9/2009 | Gretz | 439/108 |
| 2010/0279555 | A1 * | 11/2010 | Azad et al. | 439/676 |

* cited by examiner

*Primary Examiner* — Chandrika Prasad

(57) ABSTRACT

A grounding terminal block assembly that includes a conduit adapter, a grounding bar, and a detachable cover. The conduit adapter enables attachment to a wall and to electrical conduit for grounding the assembly. The conduit adapter includes one or more conduit receiving ports for attachment of electrical conduit. The grounding terminal block includes a plurality of grounding terminals for establishing connection points for grounding multiple electrical systems, including phone, data, and cable TV systems. A channel on one end of the grounding bar includes a channel and fastener for establishing a secure connection to a ground wire. Legs are provided on the grounding bar for providing direct connection to the conduit adapter. The detachable insulating cover is secured to the grounding bar to shield the grounding body and all wiring connections to the grounding body.

20 Claims, 12 Drawing Sheets

GROUNDING TERMINAL BLOCK ASSEMBLY INCLUDING CONDUIT ADAPTER FOR MULTIPLE SERVICES

This application is a Continuation-In-Part of U.S. patent application Ser. No. 12/288,968 filed Oct. 24, 2008 now U.S. Pat. No. 7,591,656, which is a Continuation-In-Part of U.S. patent application Ser. No. 12/287,244 filed Oct. 7, 2008, now U.S. Pat. No. 7,537,467, the entire contents of which are incorporated herein by reference.

FIELD OF THE INVENTION

This invention relates to terminal blocks for grounding electrical systems and specifically to a grounding terminal block assembly for grounding multiple services that is adaptable for use with electrical conduit.

BACKGROUND OF THE INVENTION

The National Electrical Code (NEC) now requires the grounding of data, cable TV, and phone lines. Grounding is the establishment of an electrical connection to earth through a path of sufficiently low impedance. As it relates to data, cable TV, and phone lines, the purpose of grounding is to assist in preventing the destruction of electrical components and property damage from superimposed voltage from lightning and voltage transients. Grounding the various connections to the earth also helps in reducing static charges on equipment surfaces to ensure the proper performance of sensitive electronic equipment. Grounding communications equipment to the earth reduces high voltage from lightning and keeps it from entering into the building or structure via metal cables or raceways. If the metal portions of communication equipment are not grounded in accordance with the NEC, a significant amount of the high energy from the lightning strike will be dissipated within the structure, which can result in equipment and property damage as well as the potential for electric shock. Grounding also helps establish a zero voltage reference point to ensure proper performance of sensitive communications equipment.

In related and commonly owned patent application Ser. No. 12/287,244, now U.S. Pat. No. 7,537,467, which has been incorporated herein by reference, there was provided a grounding block assembly for multiple services that included a die-cast tubular body with a plurality of threaded bores and a plurality of threaded fasteners for cooperating with the threaded bores for securing multiple electrical services to the tubular body for the purpose of grounding each of the separate electrical services. The grounding block assembly included integral legs that enabled direct attachment of the tubular body to a wall or similar structure. For those situations in which the grounding block assembly was used in conjunction with an electrical service panel or meter can, a threaded nose portion and lock nut on the tubular body enabled direct connection to the service panel or meter can. Side ports were provided in the tubular body for inspection purposes to enable rapid viewing of the integrity of grounding connections therein. The grounding block assembly provided a device for meeting the NEC's requirements for grounding all the electrical systems leading into the home including line voltage, data, cable TV, and phone lines.

In related and commonly owned patent application Ser. No. 12/288,968, which has been incorporated herein by reference, there was provided a grounding block assembly for grounding multiple services in conjunction with a meter can. The grounding block assembly included die-cast tubular body with a threaded nose portion and a lock nut for securing the grounding terminal block assembly to a meter can.

Although the grounding block assembly of the related applications provided grounding block assemblies for grounding multiple electrical services with connection to a meter can or directly to a wall, the grounding assemblies were not adaptable for use with electrical conduit. The present invention is a grounding terminal block assembly that includes a conduit adapter that enables connection of the grounding bar within the assembly to a ground wire routed through electrical conduit.

SUMMARY OF THE INVENTION

The invention is a grounding terminal block assembly that includes a conduit adapter, a grounding bar, and a detachable cover. The conduit adapter enables attachment to a wall and to electrical conduit for grounding the assembly. The conduit adapter includes one or more conduit receiving ports for attachment of electrical conduit. The grounding terminal block includes a plurality of grounding terminals for establishing connection points for grounding multiple electrical systems, including phone, data, and cable TV systems. A channel on one end of the grounding bar includes a channel and fastener for establishing a secure connection to a ground wire. Legs are provided on the grounding bar for providing direct connection to the conduit adapter. The detachable insulating cover is secured to the grounding bar to shield the grounding body and all wiring connections to the grounding body.

OBJECTS AND ADVANTAGES

Several advantages are achieved with the grounding terminal block assembly of the present invention, including:

(1) The grounding block assembly includes a conduit adapter with conduit receiving ports to enable rapid connection to electrical conduit.

(2) A ground to earth wire can be routed through electrical conduit to the grounding terminal assembly.

(3) A grounding block includes a plurality of grounding terminals establishing grounding for a plurality of electrical systems, including phone, data, and cable TV systems.

(4) An open channel is provided at one end of the grounding block assembly to enable rapid connection to an existing installed ground wire.

(5) The grounding block portion of the grounding block assembly is die cast in one piece of metal alloy with superior electrical conduction properties for establishing proper ground to an existing ground wire.

(6) The grounding terminal block assembly includes integral legs for direct connection to the conduit adapter and to a wall.

(7) The grounding terminal block assembly includes a detachable cover constructed of electrically nonconductive material for shielding and protecting the grounding block and its terminals.

(8) After initial installation, the detachable cover can easily be removed and reattached in order to connect additional wiring systems to the grounding terminals.

These and other objects and advantages of the present invention will be better understood by reading the following description along with reference to the drawings.

TABLE OF NOMENCLATURE

Figure 1:
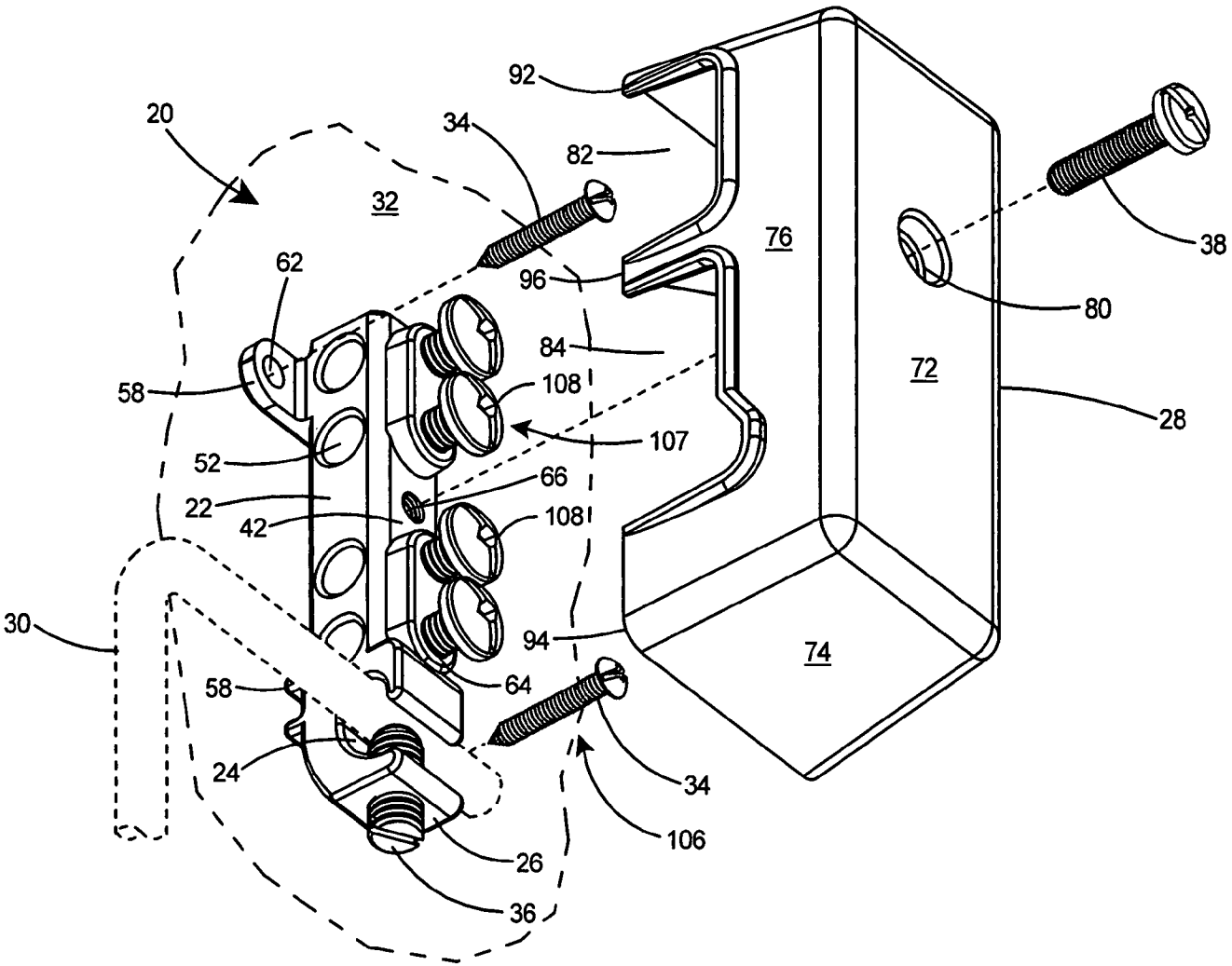
FIG. 1 is an exploded perspective view of a grounding terminal block assembly including a grounding bar portion and a detachable cover according to the present invention.

The following is a listing of part numbers used in the drawings along with a brief description:

| Part Number | Description |
|---|---|
| 20 | grounding terminal block assembly, first embodiment |
| 22 | grounding bar |
| 24 | open channel |
| 26 | first end of grounding bar |
| 28 | detachable cover |
| 30 | ground wire |
| 32 | wall |
| 34 | threaded fastener |
| 36 | screw |
| 38 | cover attachment screw |
| 40 | second end of grounding bar |
| 42 | front surface of grounding bar |
| 44 | rear surface of grounding bar |
| 46 | side surface of grounding bar |
| 48 | threaded bore |
| 50 | boss |
| 52 | side bore |
| 53 | longitudinal axis through grounding bar |

-continued

| Part Number | Description |
|---|---|
| 54 | wide gap |
| 56 | inner seat |
| 58 | leg |
| 60 | front surface of leg |
| 62 | aperture in leg |
| 64 | threaded bore in boss |
| 66 | central bore in front surface of grounding bar |
| 68 | longitudinal rib |
| 70 | axis of threaded bore |
| 72 | top panel of cover |
| 74 | end panel |
| 76 | side panel |
| 78 | rear edge |
| 80 | aperture in cover |
| 82 | first side opening |
| 84 | second side opening |
| 86 | back surface |
| 88 | cover boss |
| 90 | rear surface of cover boss |
| 92 | first end leg |
| 94 | second end leg |
| 96 | intermediate leg |
| 98 | Y-shaped inner support |
| 100 | rib |
| 102 | longitudinal brace |
| 104 | lateral rib |
| 106 | mounting arrangement |
| 107 | ground wire fastening arrangement |
| 108 | threaded fastener or terminal screws |
| 110 | filet |
| 112 | ground wire |
| 120 | grounding terminal block assembly, preferred embodiment |
| 122 | conduit adapter |
| 124 | electrical conduit |
| 126 | base plate |
| 128 | end of base plate |
| 130 | side of base plate |
| 132 | front surface of base plate |
| 134 | conduit receiver |
| 136 | conduit receiving port |
| 138 | aperture in base plate |
| 140 | aperture in base plate |
| 142 | cylindrical side wall |
| 144 | end wall |
| 146 | fastening arrangement |
| 148 | wall |
| 150 | fastener |
| 152 | mounting arrangement |
| 154 | threaded fastener |
| 156 | ground wire |
| 158 | cover fastening arrangement |
| 160 | opening |
| 162 | axial center of threaded bore |
| 164 | axial center of side bore |
| D1 | distance across wide gap |
| $\theta_1$ | radius of inner seat portion of open channel |

DETAILED DESCRIPTION OF THE INVENTION

With reference to FIG. 1, a first embodiment of the present invention comprises a grounding terminal block assembly 20 for attachment to a previously installed ground wire in order to provide several additional grounding terminals for grounding several additional electrical systems to the earth. The grounding terminal block assembly 20 includes an elongated grounding bar portion 22 with an open channel 24 at a first end 26 and a detachable cover 28. In FIG. 1 the grounding bar 22 has been slipped over an existing ground wire 30 by orienting the open channel 24 of the grounding bar 22 with the ground wire 30 and slipping it over the installed ground wire 30. The grounding bar 22 is then secured to the wall 32 with threaded fasteners 34, A screw 36, which is provided as part of the grounding terminal block assembly 20, is then tightened onto ground wire 30 thereby securing the ground wire 30 to the grounding bar 22. Detachable cover 28 is then secured to grounding bar 22 with cover attachment screw 38.

Figure 3:
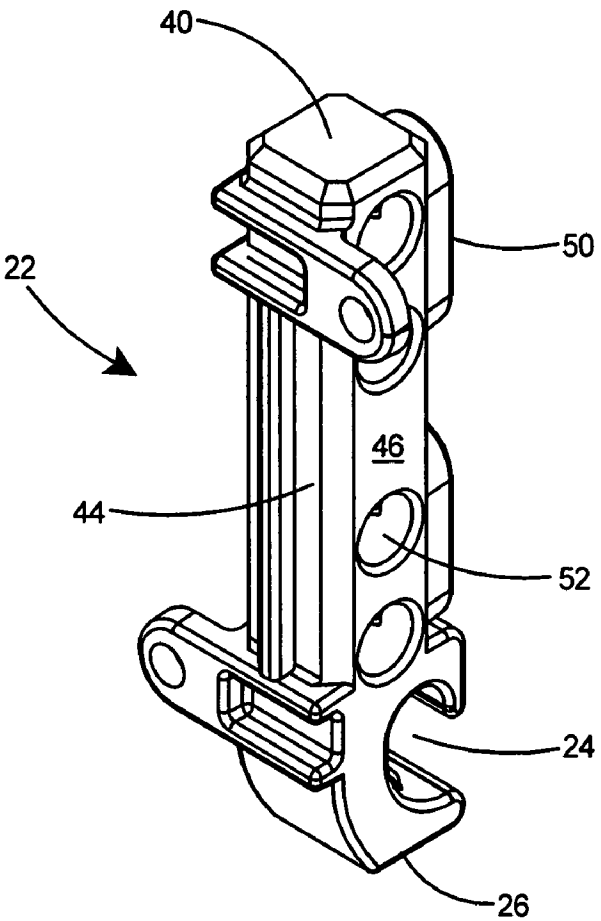
FIG. 3 is a rear perspective view of the grounding bar of FIG. 2.
Figure 2:
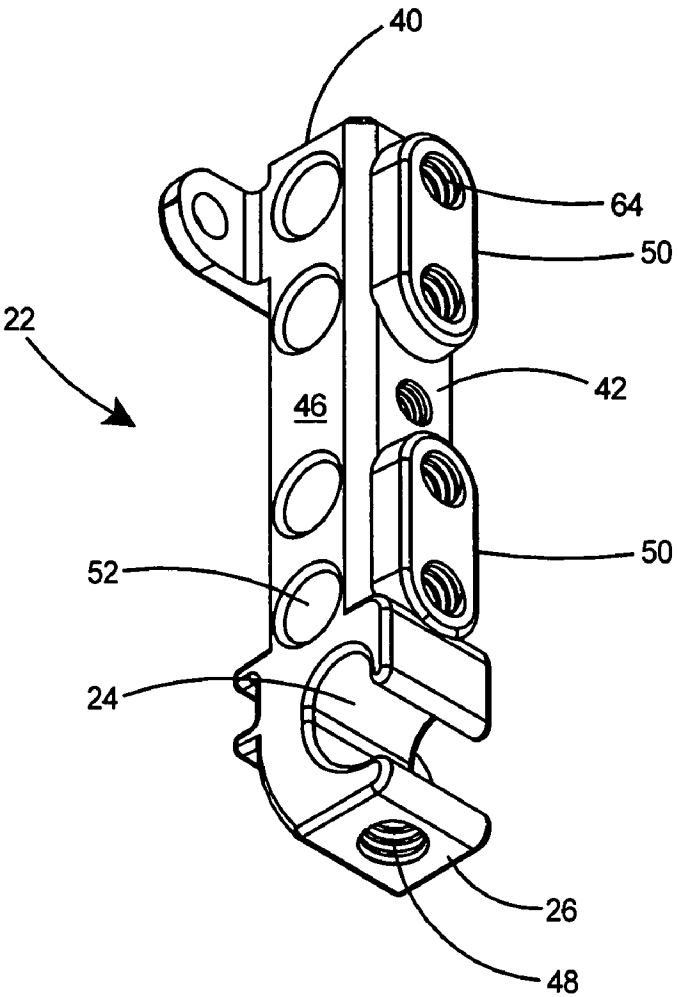
FIG. 2 is a front perspective view of the grounding bar portion of the grounding terminal block assembly of FIG. 1.

Referring to FIGS. 2 and 3, the elongated grounding bar 22 further includes a second end 40, a front surface 42, a rear surface 44, and two side surfaces 46. The elongated grounding bar 22 is preferably constructed of electrically conductive metals. The tubular body is preferably produced in one-piece and is die-cast of metal. A threaded bore 48 extends into the grounding bar 22 at the first end 26.

Figure 4:
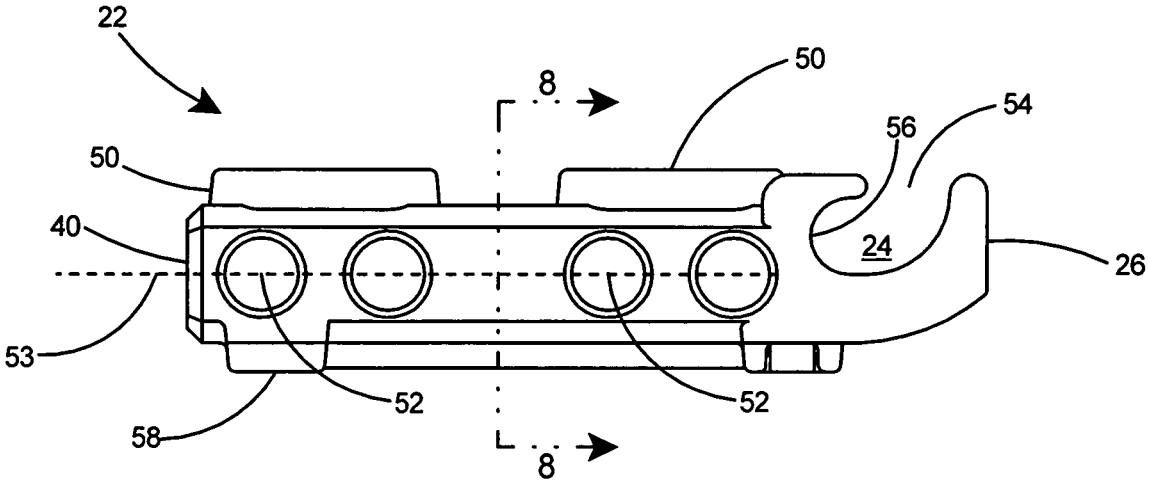
FIG. 4 is a side view of the grounding bar.

With reference to FIG. 4, the grounding bar 22 includes a plurality of bosses 50 extending from the front surface 42. A plurality of side bores 52 aligned along longitudinal axis 53 extend through the grounding bar 22. The front 42, rear 44, and side surfaces 46 of the grounding bar 22 are flat. The open channel 24 in grounding bar 22 includes a wide gap 54 leading therein and an inner seat 56. The wide gap 54 enables the channel 24 portion of the grounding bar 22 to be slipped over a ground wire (not shown) and the ground wire advanced until seated in inner seat 56.

Figure 5:
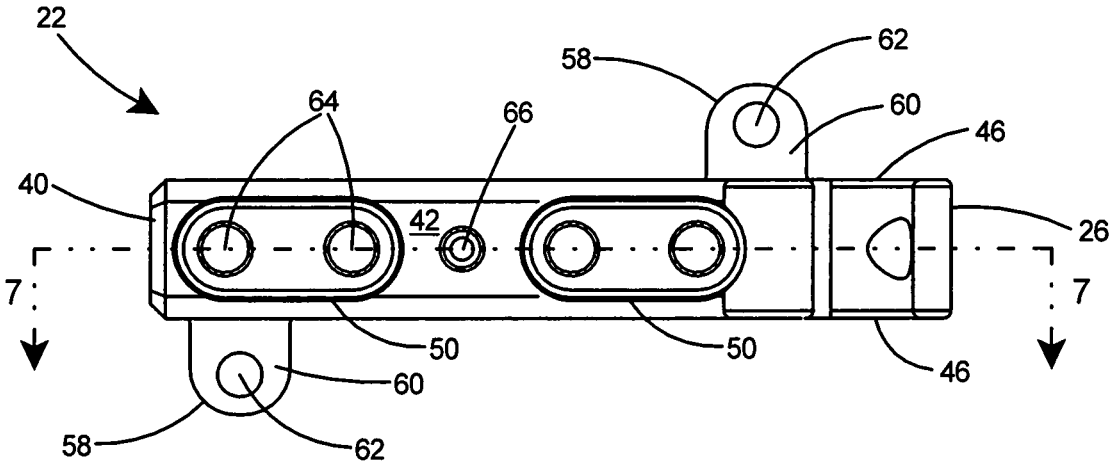
FIG. 5 is a front view of the grounding bar.

As shown in FIG. 5, two legs 58 are integral with and extend outwards from the grounding bar 22 with the legs 58 extending from opposite sides 46 of the grounding bar 22. Each of the legs 58 includes a front surface 60 and an aperture 62 therein. The apertures 62 are at right angles with respect to the front surface 60 of the legs 58 and also with respect to the front surface 42 of the grounding bar 22. A plurality of threaded bores 64 are provided extending into the bosses 50 and a central bore 66 is provided between the two bosses 50 extending into the front surface 42 of the grounding bar 22.

Figure 6:
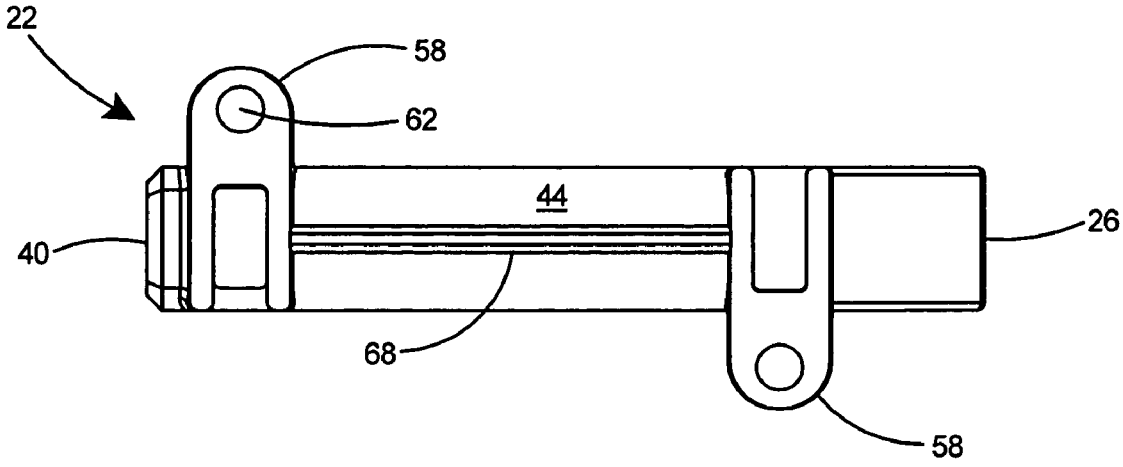
FIG. 6 is a rear view of the grounding bar.
Figure 7:
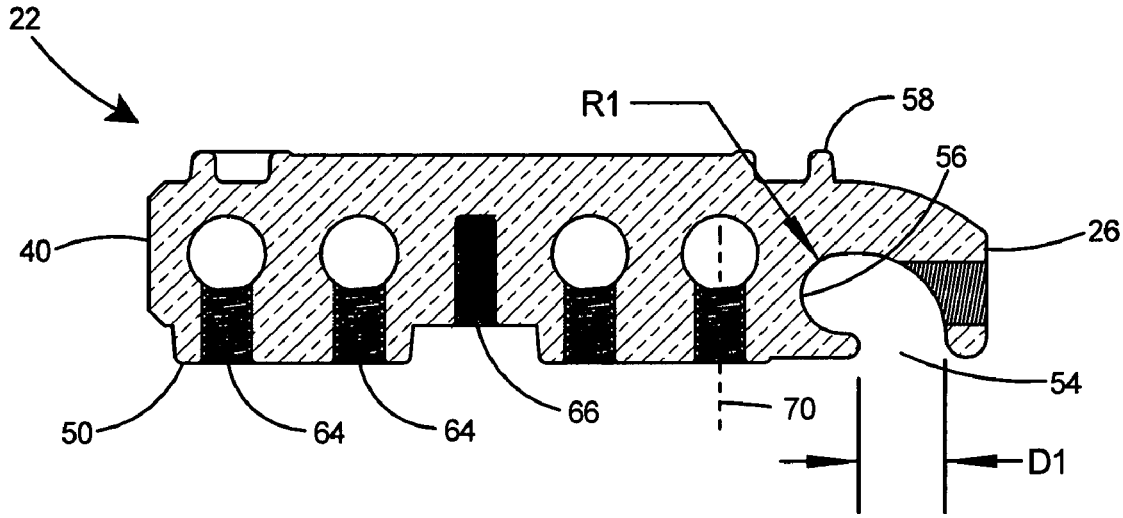
FIG. 7 is a sectional view of the grounding bar taken along line 7-7 of FIG. 5.
Figure 8:
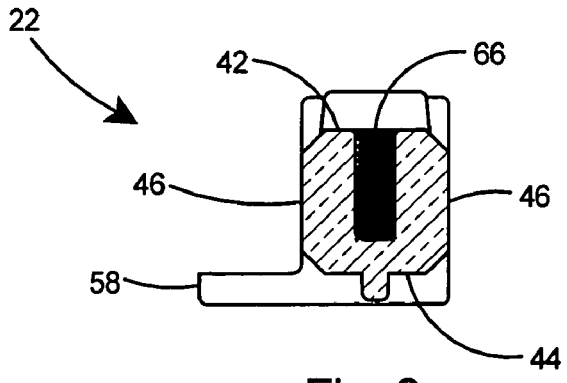
FIG. 8 is a sectional view of the grounding bar taken along line 8-8 of FIG. 4.

Referring to FIGS. 6-8, the rear surface 44 of the grounding bar 22 includes a longitudinal rib 68 extending there from. The longitudinal rib 68 extends between and joins the two legs 58 thereby providing rigidity and support and bracing the legs 58. As shown in FIG. 7, the plurality of threaded bores 64 extend into the grounding bar 22 and include axes 70 that are perpendicular to the front surface 42 of the grounding bar 22.

Figure 10:
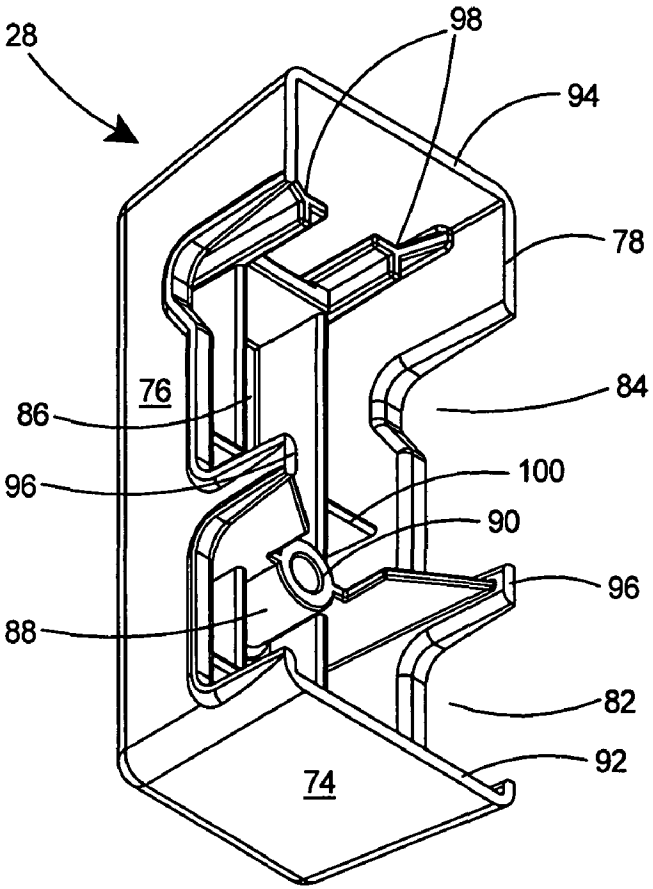
FIG. 10 is a rear perspective view of the detachable cover.
Figure 9:
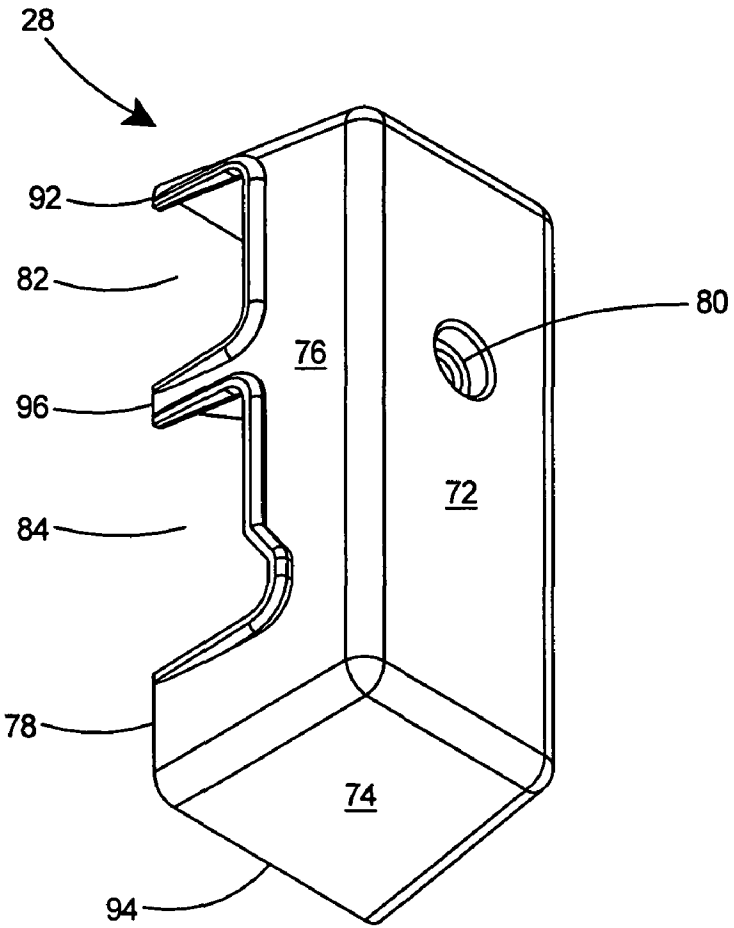
FIG. 9 is a front perspective view of the detachable cover portion of the grounding terminal block assembly of FIG. 1.

With reference to FIGS. 9 and 10, detachable cover 28 includes a top panel 72, end panels 74, side panels 76 and a rear edge 78. Top panel 72 includes an aperture 80 therein and side panels 76 include a first side opening 82 and second side opening 84. The back surface 86 of the top panel 72 includes an integral cover boss 88 projecting therefrom, with cover boss 88 including a rear surface 90. Side openings 82 and 84 divide the cover 28 into a first end leg 92, a second end leg 94, and intermediate legs 96.

Figure 11:
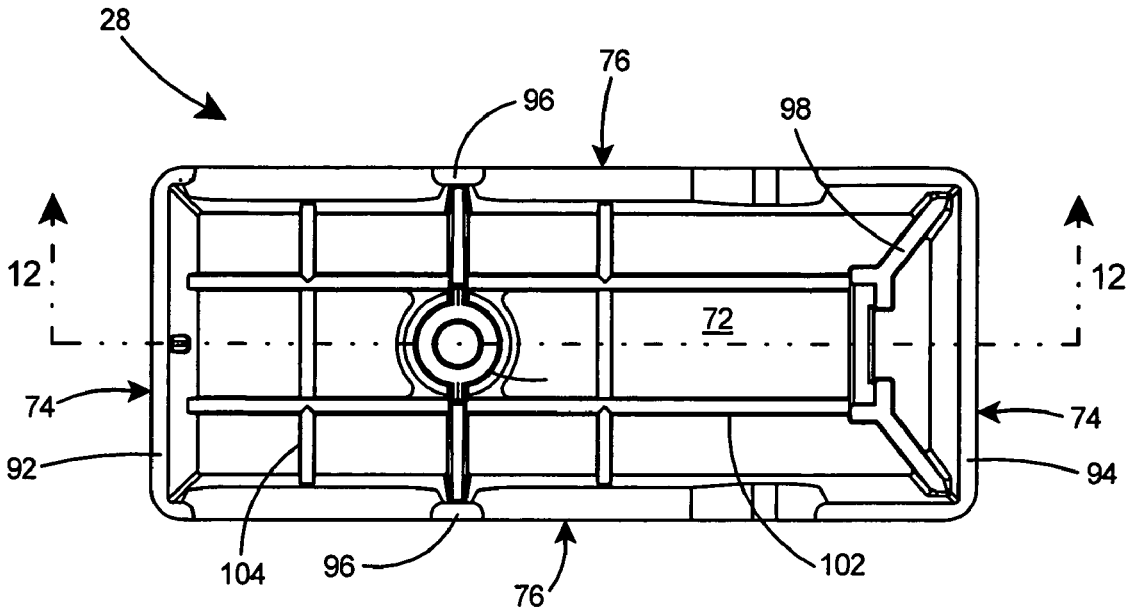
FIG. 11 is a rear view of the detachable cover.
Figure 12:
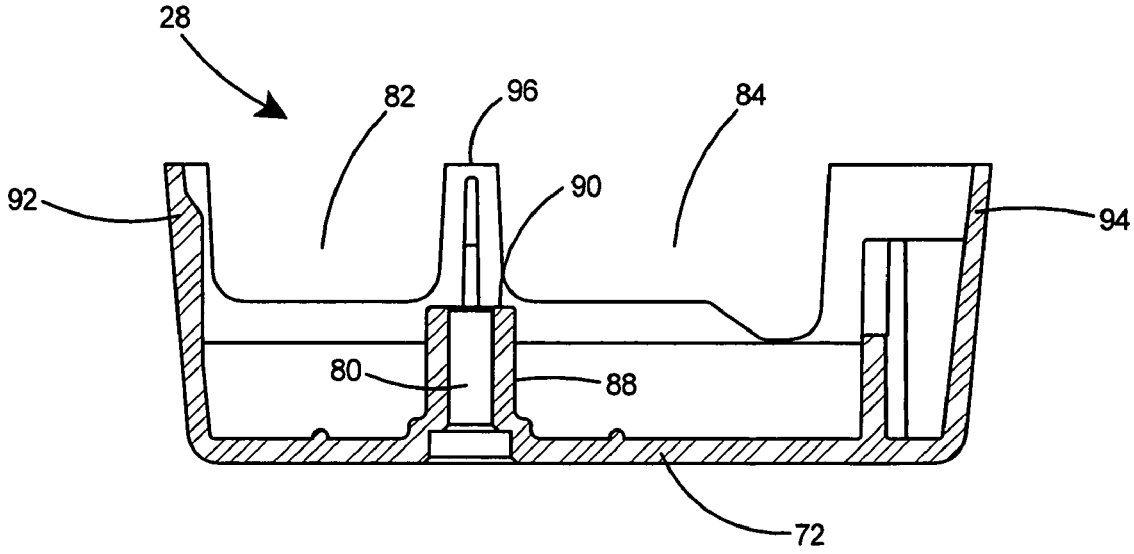
FIG. 12 is a sectional view of the cover taken along line 12-12 of FIG. 11.

Referring to FIGS. 11 and 12, second end leg 94 is braced to said end panel 74 and said side panel 76 by Y-shaped inner supports 98 and intermediate legs 96 are braced by ribs 100 extending from the cover boss 88. A pair of longitudinal braces 102 extends between the Y-shaped inner supports 98 and the first end leg 92 and lateral ribs 104 extend between the side panels 76 and the longitudinal braces 102 to further brace the cover 28.

Reference is made to FIG. 1 for a description of the operation of the present invention. Grounding terminal block assembly 20 includes a mounting arrangement 106 for securing the grounding block 22 to a wall 32 or similar structure. The grounding terminal block assembly 20 is an adjunct grounding block that is designed to be slipped over an existing ground wire 30 as shown in FIG. 1. Initially grounding terminal block assembly 20 includes screw 36 in a loosened state thereby providing a wide gap 54 at the entrance to open channel 24. To operate the grounding terminal block assembly 20, the installer removes the detachable cover 28, aligns the open channel 28 with the ground wire 30, and slips the grounding bar 22 under the ground wire 30 such that the ground wire 30 enters the open channel 24. Screw 36 is then tightened upon ground wire 30 and the grounding bar 22 is mounted to the wall 32 using mounting arrangement 106 consisting of threaded fasteners 34 tightened through apertures 62 in legs 58 of grounding bar 22. After the grounding bar 22 is secured to the ground wire 30 and mounted to the wall 32, then individual ground wires (not shown) are secured to the grounding bar 22 by a ground wire fastening arrangement 107 including a plurality of electrically conductive terminal screws 108. As the grounding bar 22 is die-cast in one piece of electrically conductive material, all ground wires connected to the grounding bar 22 by terminal screws 108 will conduct any voltage surges through the grounding bar 22 to the existing ground wire 30 and thus to earth ground thereby protecting the electrical systems connected by the terminal screws 108.

After the grounding bar 22 is mounted to the wall 32 and ground wires are connected to the grounding bar 22 by the terminal screws 108, detachable cover 28 is secured to the grounding bar 22 by cover attachment screw 38 secured into the central bore 66 in the front surface 42 of grounding bar 22. If only a portion of grounding terminals 108 are in use and additional electrical systems are required to be grounded, detachable cover 28 may be later temporarily removed and additional ground wires connected to the grounding terminals 108, after which the cover 28 is replaced. In case there are more electrical systems to be grounded than available terminal screws 108, additional grounding terminal block assemblies 20 could be connected at other locations along the ground wire 30, in the same manner as described above, to increase the number of available grounding connection points.

Figure 13:
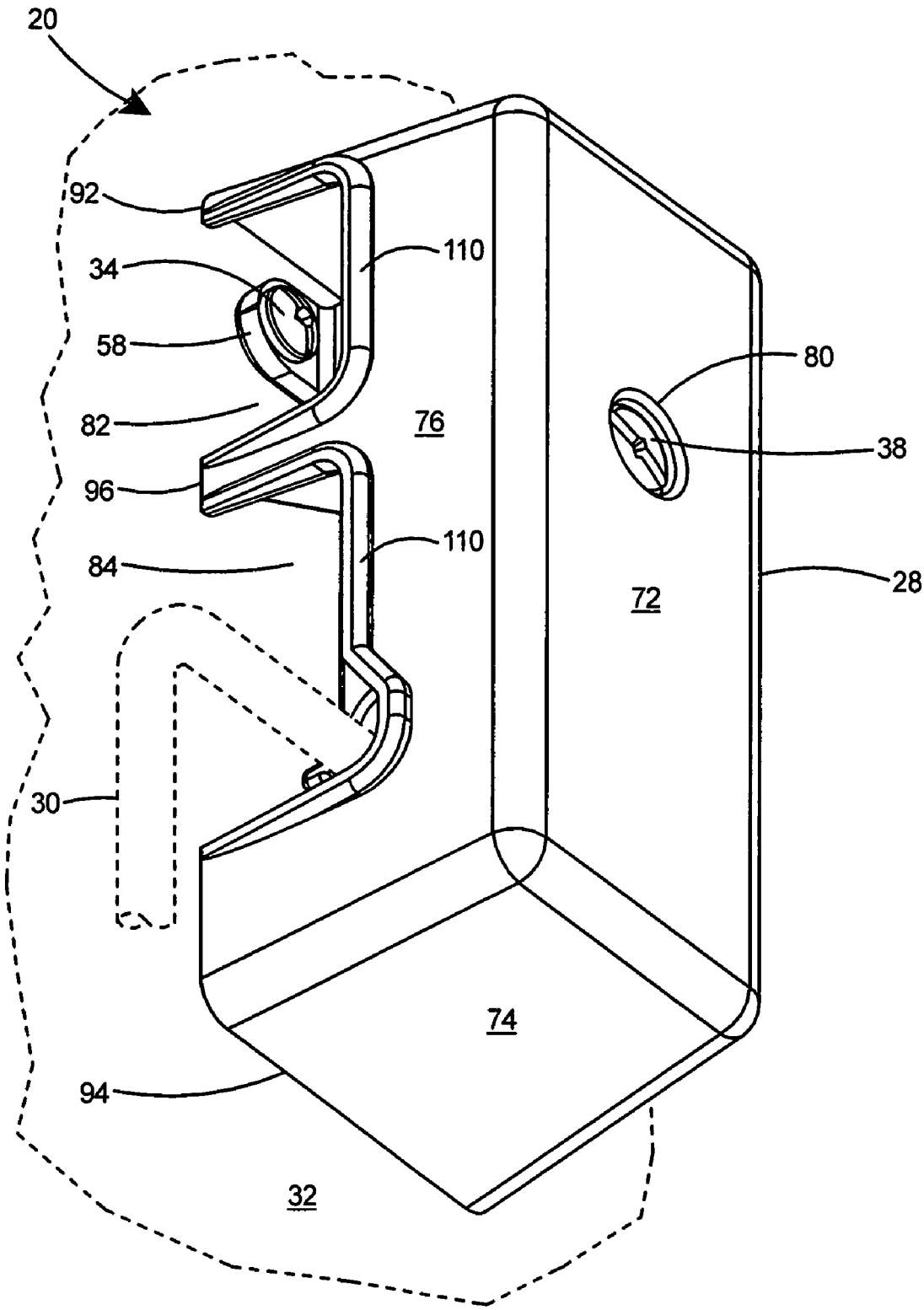
FIG. 13 is a perspective view of a grounding terminal block assembly according to the present invention secured to a wall and with the cover secured to the grounding bar.

With reference to FIG. 13, after the grounding terminal block assembly 20 is secured to a wall 32, first and second side openings 82 and 84 provide entry ports for admitting the main ground wire 30 and ground wires for connection to the individual terminal screws (not shown). Thus, the side openings 82 and 84, included on both sides 76 of the cover 28, enable many different ground wire configurations and connections with the same detachable cover 28. Filets 110 are provided around the peripheries of the side openings 82 and 84 to add rigidity and strength to the side panels 76 of the one piece molded detachable cover.

As shown in FIG. 7, it is critical that the open channel 24 of the grounding bar 22 is sized to accommodate most nominal sizes of ground wires in established grounding systems. Most preferably the radius R1 of the inner seat 56 of open channel 24 is at least 0.165 inch and the distance D1 across the wide gap 54 is at least 0.34 inch.

Figure 14:
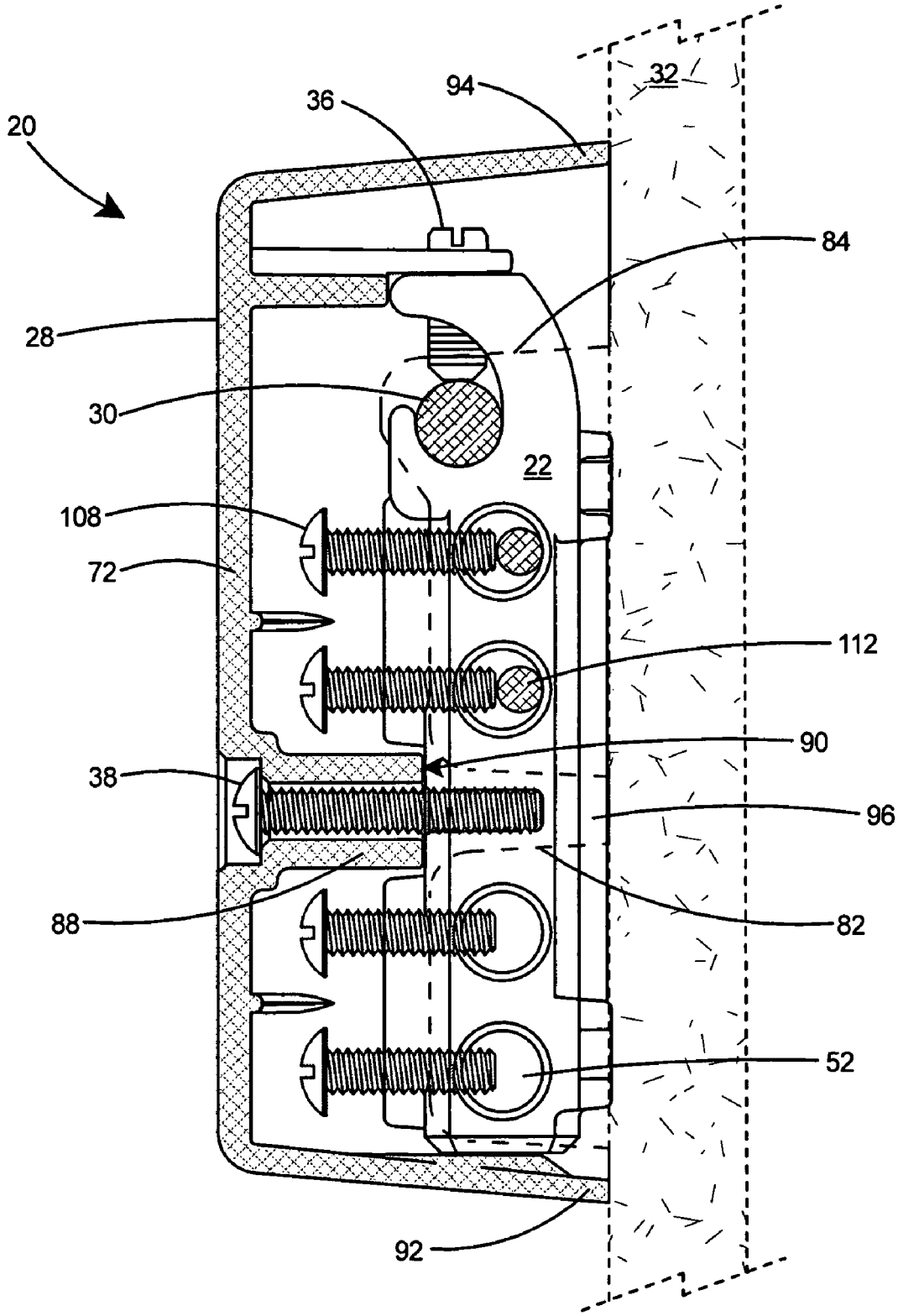
FIG. 14 is a side view of the grounding terminal block assembly secured to a wall and with the cover in sectional view secured to the grounding bar.

Referring to FIG. 14, when the detachable cover 28 is secured to the grounding bar 22, the rear surface 90 of cover boss 88 contacts the front surface 42 of the grounding bar 22. Cover boss 88 therefore positions the top panel 72 of the cover 28 above the grounding bar 22 and provides sufficient space inside the cover 28 for terminal screws 108 whether they have ground wires connected to them or not. The cover boss 88 also positions the first end leg 92, second end leg 94, and intermediate leg 96 flush with the wall 32. First side opening 82 and second side opening 84 (in dashed lines) enable easy viewing of the ground wire 30 to earth and any ground wires 112 that are connected to electrical systems.

Figure 15:
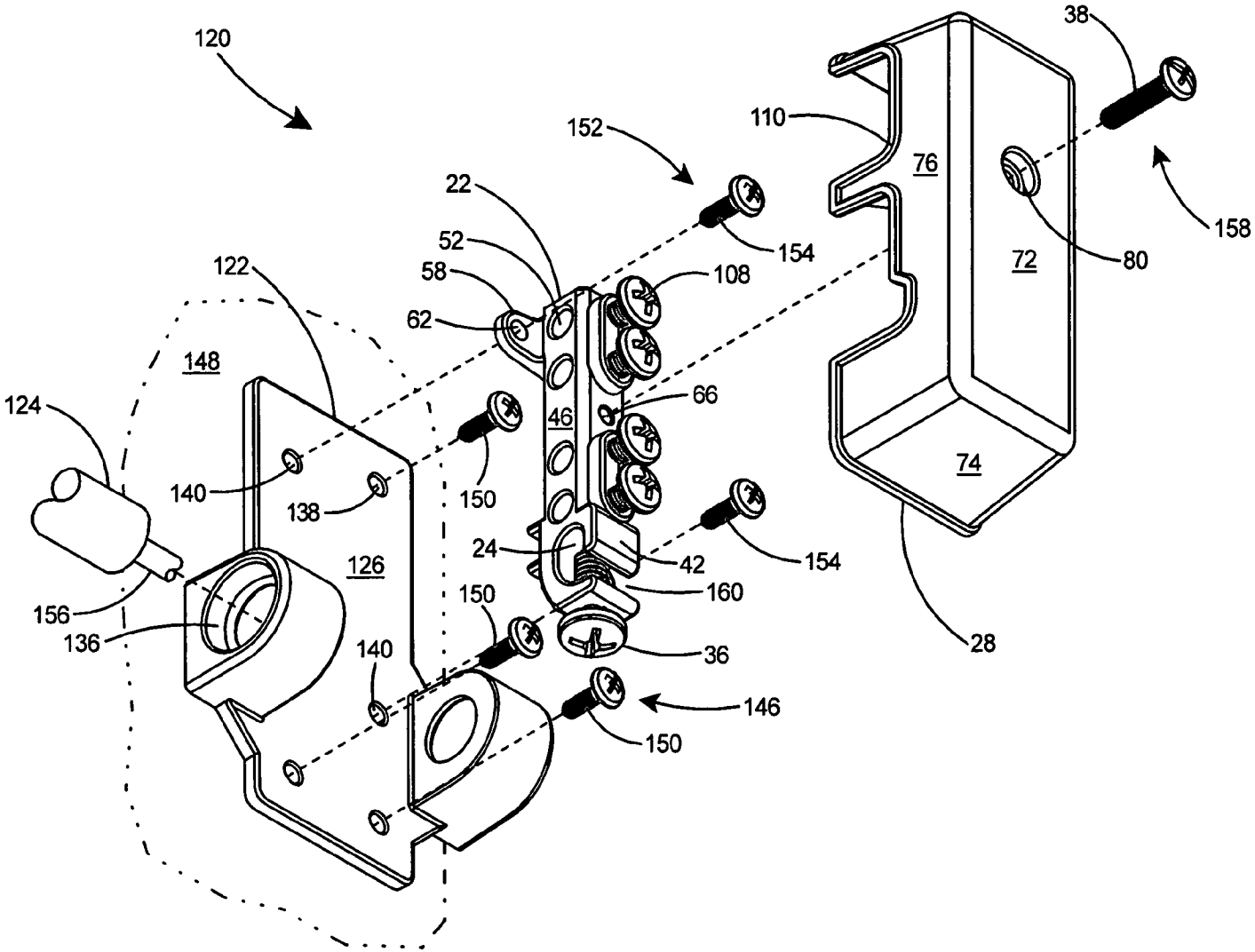
FIG. 15 is an exploded perspective view of the preferred embodiment of a grounding terminal block assembly adapted for use with electrical conduit according to the present invention.

With reference to FIG. 15 there is shown a preferred embodiment of grounding terminal block assembly 120 according to the present invention. The preferred embodiment of the assembly 120 includes the elongated grounding bar portion 22 and detachable cover 28 of the first embodiment and in addition includes a conduit adapter 122 that adapts the grounding assembly for connection to electrical conduit 124.

Figure 16:
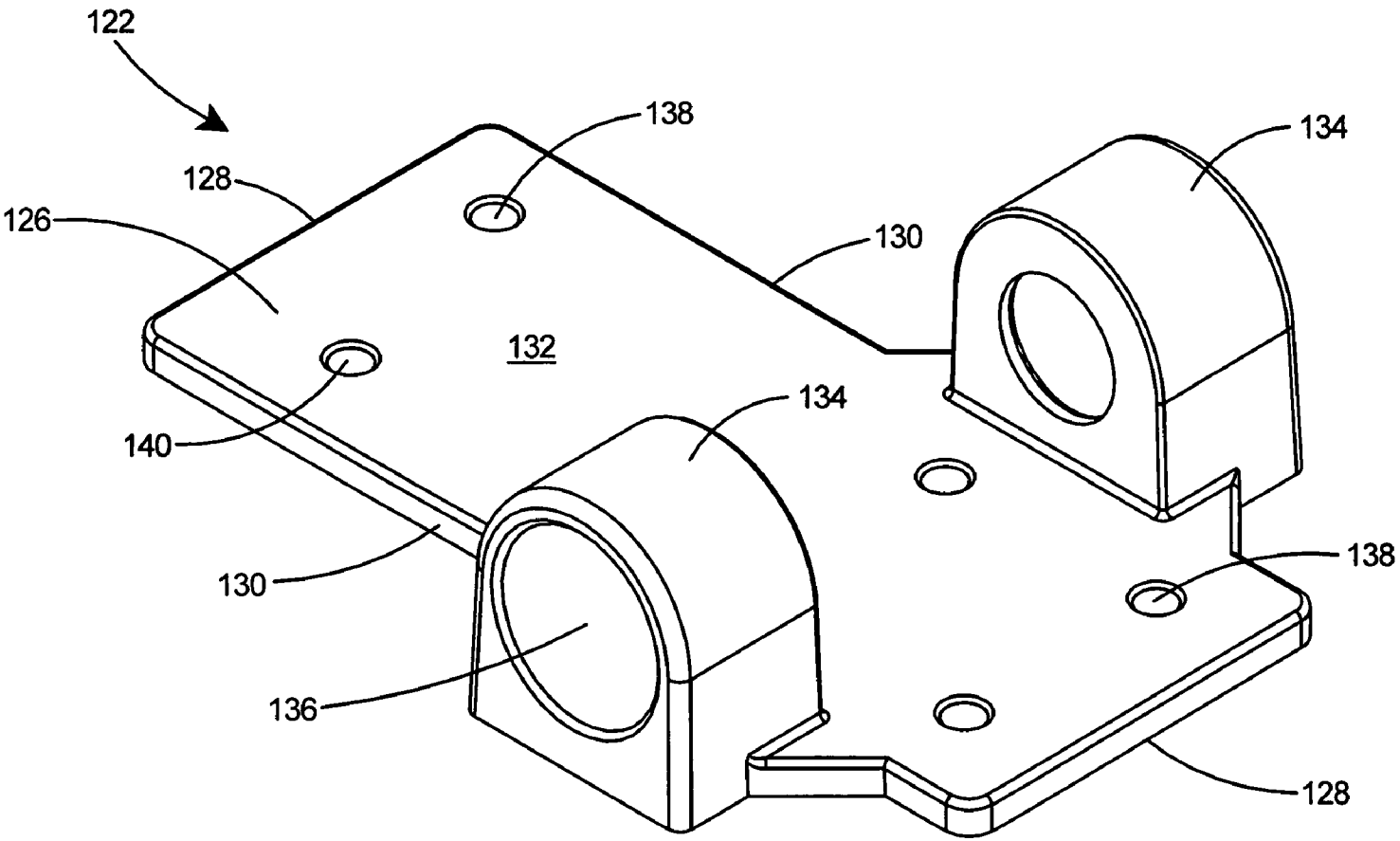
FIG. 16 is a perspective view of a conduit adapter that forms a portion of the preferred embodiment of the grounding terminal block assembly of FIG. 15.
Figure 17:
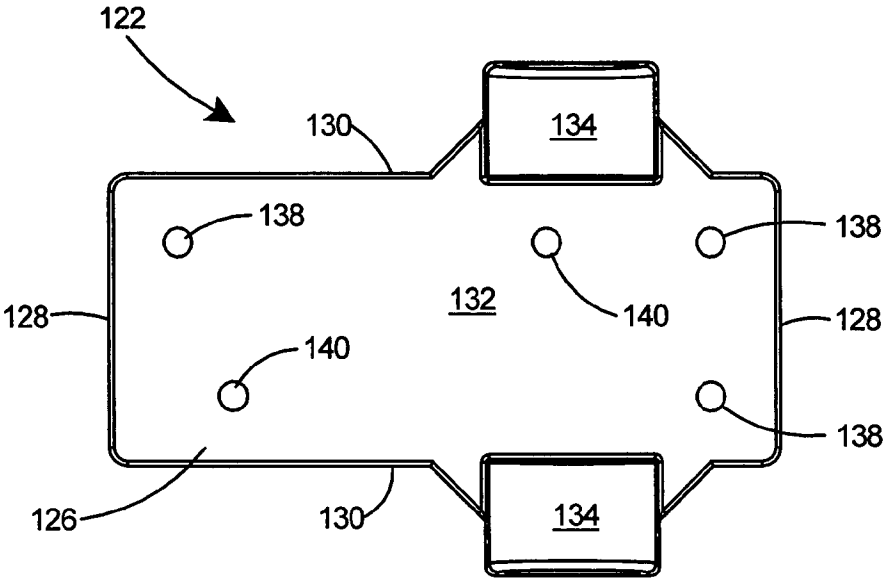
FIG. 17 is a plan view of the conduit adapter of FIG. 16.
Figure 19:
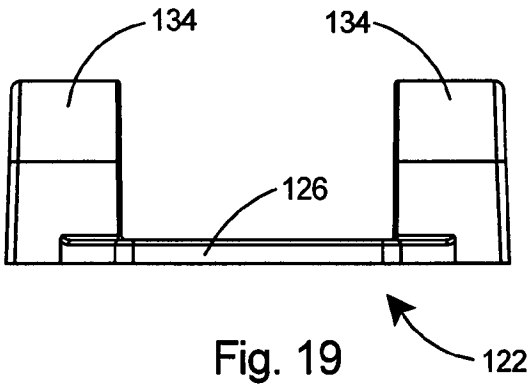
FIG. 19 is an end view of the conduit adapter of FIG. 17.
Figure 18:
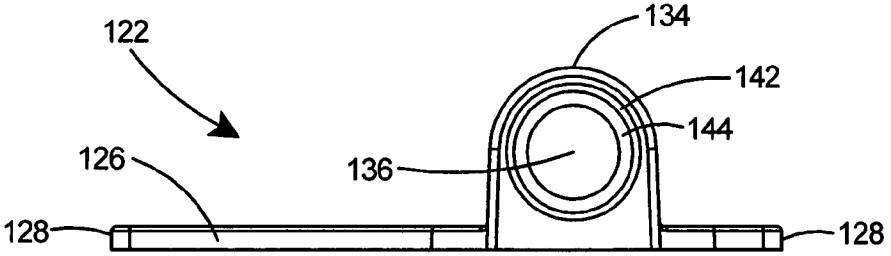
FIG. 18 is a side view of the conduit adapter of FIG. 17.
Figure 20:
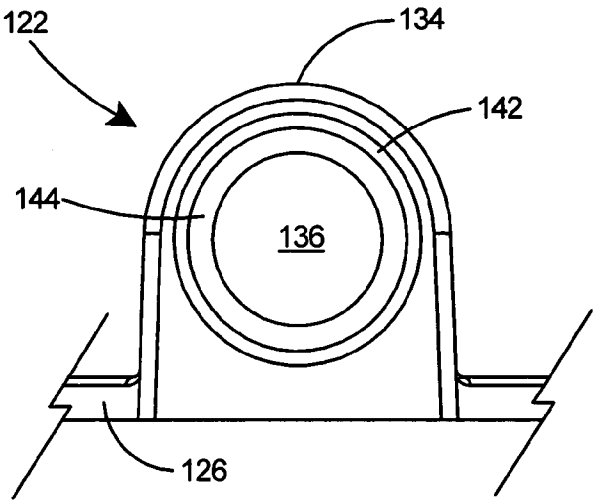
FIG. 20 is a side view of the conduit receiving port portion of the conduit adapter of FIG. 18.
Figure 21:
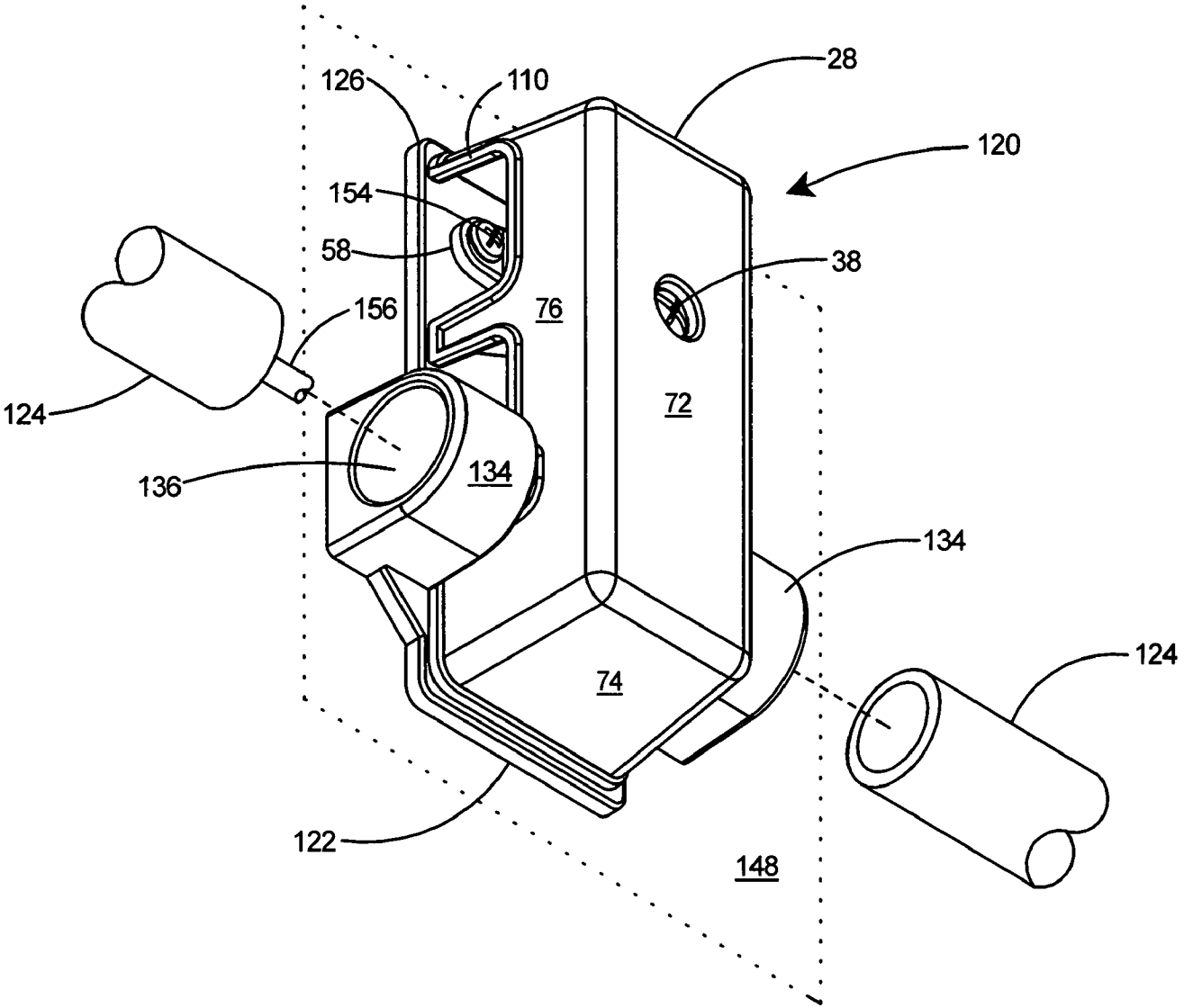
FIG. 21 is a perspective view of the grounding terminal block assembly of FIG. 15 mounted on a wall and including electrical conduit in alignment for connection thereto.

As shown in FIG. 16, conduit adapter 122 includes a base plate 126 having two ends 128, two sides 130, and a front surface 132. At least one conduit receiver 134 is provided extending from one of the sides 130 of the base plate 126. The embodiment of the conduit adapter 122 depicted in FIG. 16 includes two conduit receivers 134 each of which includes a cylindrical conduit receiving port 136 therein.

With reference to FIGS. 17 to 20, the base plate 126 portion of the conduit adapter 122 includes a plurality of apertures 138 therein that will accommodate fasteners (not shown) for mounting the conduit adapter 122 to a wall. Base plate 126 further includes apertures 140 that will accommodate mounting of the grounding bar (not shown) thereto. In the preferred embodiment of the grounding terminal block assembly 120, the conduit receiving ports 136 include cylindrical side walls 142 and an end wall 144.

Referring to FIG. 15, the preferred embodiment of the grounding terminal block assembly 120 of the present invention includes a fastening arrangement 146 for securing the conduit adapter 122 to a wall 148. The fastening arrangement 146 includes fasteners 150 that may be driven through each of the apertures 138 in the base plate 126 and thence into the wall 148. A mounting arrangement 152 for mounting the grounding bar 22 to the conduit adapter 122 includes threaded fasteners 154 that are driven through the apertures 62 in each leg 58 of grounding bar 22 and thence into apertures 140 in the base plate 126 portion of the conduit adapter 122.

For the operation of the preferred embodiment of the grounding terminal block assembly 120, reference is made to FIG. 15. In a typical application, an existing electrical conduit 124 has previously been installed on the wall 148 and includes a ground wire 156 therein that is connected to earth ground. The installer secures the conduit adapter 122 to the wall 148 in close proximity to the conduit 124. The conduit adapter 122 is then secured to wall 148 by driving fasteners 150 of fastening arrangement 146 through apertures 138 into the wall 148. The end of electrical conduit 124 is glued into conduit receiving port 136 either before or after conduit adapter 122 is secured to the wall 148. The grounding bar 22 is then secured to the wall and conduit adapter 122 by driving threaded fasteners 154 of mounting arrangement 152 through apertures 62 in legs 58 of grounding bar 22 and through apertures 140 in base plate 126 into wall 148. The conduit adapter 122 is sandwiched between the grounding bar 22 and the wall 148. Ground wire 156 is then secured in channel 24 by screw 36. Wires from the various electrical systems that are desired to be grounded are then routed into side bores 52 and secured therein by terminal screws 108. Lastly, after all wiring connections are complete, detachable cover 28 is secured to grounding bar 22 by threading cover attachment screw 38 of cover fastening arrangement 158 into central bore 66 of grounding bar 22. The open channel 24 of grounding terminal block assembly 120 extends between the side surfaces 46 of the grounding bar 22 and includes an opening 160 in the front surface 42 of the grounding bar 22.

Figure 22:
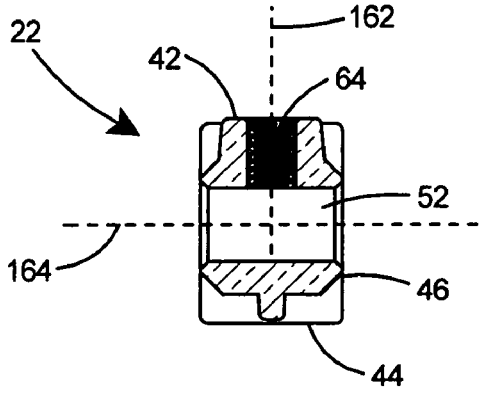
FIG. 22 is a sectional view of the grounding bar taken along line 22-22 of FIG. 7.

With reference to FIG. 22, the threaded bores 64 in the grounding bar 22 include axial centers 162 and the side bores 52 in the grounding bar 22 include axial centers 164. As shown in FIG. 22, the axial center 164 of the side bores 52 and the axial centers 162 of the threaded bores 64 extending from the front surface 42 of the grounding bar 22 intersect and are perpendicular to one another.

The conduit adapter 122 is preferably molded in one piece of an electrically insulating material such as plastic. The plastic used to form the conduit adapter 122 is preferably polyvinyl chloride (PVC). Conventional electrical conduit is typically constructed of polyvinyl chloride. Conduit adapter 122 is typically constructed of polyvinyl chloride to enable the use of conventional PVC adhesives for securing electrical conduit within the conduit receiving ports 136 of the conduit adapter 122.

The grounding bar 22 of the grounding terminal block assembly is preferably constructed of an electrically conductive material. Preferably the grounding bar 22 is constructed of metal with preferred metals including zinc, aluminum, brass, copper, and zinc alloys including aluminum, magnesium, and copper. Most preferably the elongated grounding bar 22 is die cast in one piece from a die-casting alloy. An especially preferred die-casting alloy is Zamak-7.

Detachable cover 28 is preferably molded in one piece of an electrically insulating material such as plastic. The plastic used to form the detachable cover 28 is preferably polypropylene, polyethylene, polyvinyl chloride (PVC), acrylonitrile-butadiene styrene (ABS), or polycarbonate.

Having thus described the invention with reference to a preferred embodiment, it is to be understood that the invention is not so limited by the description herein but is defined as follows by the appended claims.

What is claimed is:

1. A grounding terminal block assembly for multiple services comprising:

a conduit adapter including a base plate having two ends, two sides, and a front surface;

at least one conduit receiver extending from a first of said sides of said base plate of said conduit adapter, said conduit receiver including a cylindrical conduit receiving port therein;

an elongated grounding bar including two ends, a front surface, a rear surface, and two side surfaces;

a fastening arrangement for securing said conduit adapter to a wall;

a mounting arrangement for securing said grounding bar to said wall and said conduit adapter;

a detachable cover for covering said front surface of said grounding bar; and a cover fastening arrangement for securing said detachable cover to said grounding bar.

2. The grounding terminal block assembly of claim 1 wherein said fastening arrangement for securing said conduit adapter to a wall includes a plurality of apertures in said base plate of said conduit adapter; and a fastener corresponding to each of said apertures in said base plate.

3. The grounding terminal block assembly of claim 1 wherein said mounting arrangement for securing said grounding bar to said conduit adapter includes one or more legs extending outward from said grounding bar, each of said legs including an aperture therein;

an aperture in said base plate of said conduit adapter corresponding with each of said apertures in said legs of said grounding bar; and a fastener for securing through said legs of said grounding bar and said apertures in said base plate of said conduit adapter into said wall.

4. The grounding terminal block assembly of claim 1 wherein said conduit receiving port includes cylindrical side walls and an end wall.

5. The grounding terminal block assembly of claim 1 wherein said cover fastening arrangement for securing said detachable cover to said grounding bar includes a central bore in said front surface of said grounding bar;
an aperture in said detachable cover; and
a cover attachment screw for securing through said aperture in said cover into said central bore in said grounding bar.

6. The grounding terminal block assembly of claim 1 including
a plurality of threaded bores extending into said grounding bar from said front surface; and
said threaded bores in said grounding bar perpendicular with respect to said front surface.

7. The grounding terminal block assembly of claim 1 including
an open channel at one of said ends of said grounding bar;
said open channel extending between said side surfaces of said grounding bar; and
said open channel including an opening in said front surface of said grounding bar.

8. The grounding terminal block assembly of claim 1 including a longitudinal rib extending along and centered on said rear surface of said grounding bar, said longitudinal rib extending between said legs.

9. The grounding terminal block assembly of claim 1 including
a ground wire fastening arrangement on said terminal block assembly;
said ground wire fastening arrangement including a terminal screw threaded into each of said threaded bores.

10. The grounding terminal block assembly of claim 6 including
a plurality of side bores extending through said grounding bar from said side surfaces; and
each of said side bores intersecting one of said threaded bores in said grounding bar from said front surface.

11. The grounding terminal block assembly of claim 10 wherein
said threaded bores in said grounding bar include axial centers;
said side bores in said grounding bar include axial centers; and
said axial centers of said side bores and said axial centers of said threaded bores intersect.

12. The grounding terminal block assembly of claim 6 including bosses integral with and extending from said front surface of said grounding bar, said threaded bores extending through said bosses.

13. The grounding terminal block assembly of claim 1 wherein said detachable cover includes
a front panel, two end panels, and two side panels, said front panel including a back surface; and
a first side opening and a second side opening in said side panels.

14. The grounding terminal block assembly of claim 13 wherein said side openings of said detachable cover divide said cover into
a first end leg;
a second end leg; and
an intermediate leg.

15. The grounding terminal block assembly of claim 13 wherein said detachable cover includes
a cover boss extending rearward from said back surface of said front panel; and
a rear surface on said cover boss.

16. The grounding terminal block assembly of claim 14 wherein
said second leg of said detachable cover is braced to said end panel and said side panel by Y-shaped inner supports; and
said intermediate leg is braced by ribs extending from said cover boss.

17. The grounding terminal block assembly of claim 16 wherein said detachable cover includes
a pair of longitudinal braces extending between said Y-shaped inner supports and said first end leg; and
a lateral rib extending between said side panels and said pair of longitudinal braces.

18. The grounding terminal block assembly of claim 1 wherein
said elongated grounding bar is constructed of metal; and
said metal is selected from the group including zinc, aluminum, brass, copper, and zinc alloys including aluminum, magnesium, and copper.

19. The grounding terminal block assembly of claim 13 including a filet on said side panel of said detachable cover around the periphery of said first side opening and said second side opening.

20. The grounding terminal block assembly of claim 1 wherein said conduit adapter is molded in one piece of polyvinyl chloride.

* * * * *